US011796191B2

(12) United States Patent
Lee et al.

(10) Patent No.: US 11,796,191 B2
(45) Date of Patent: Oct. 24, 2023

(54) HEAT EXCHANGER AND AIR CONDITIONER INCLUDING SAME

(71) Applicant: Samsung Electronics Co., Ltd., Suwon-si (KR)

(72) Inventors: Sang Mu Lee, Yokohama (JP); Hyun Young Kim, Yokohama (JP); Seiji Sato, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 382 days.

(21) Appl. No.: 17/272,422

(22) PCT Filed: Aug. 26, 2019

(86) PCT No.: PCT/KR2019/010827
§ 371 (c)(1),
(2) Date: Mar. 1, 2021

(87) PCT Pub. No.: WO2020/045913
PCT Pub. Date: Mar. 5, 2020

(65) Prior Publication Data

US 2021/0332986 A1 Oct. 28, 2021

(30) Foreign Application Priority Data

Aug. 27, 2018 (JP) ..... 2018-158691

(51) Int. Cl.
*F24F 1/0067* (2019.01)
*F24F 1/18* (2011.01)
(Continued)

(52) U.S. Cl.
CPC ..... *F24F 1/0067* (2019.02); *F24F 1/18* (2013.01); *F25B 39/02* (2013.01); *F28F 1/128* (2013.01);
(Continued)

(58) Field of Classification Search
CPC .. F24F 1/0067; F24F 1/18; F24F 1/128; F24F 1/30; F24F 17/00; F24F 2215/08; F25B 39/02; F25B 2339/0241
(Continued)

(56) References Cited

U.S. PATENT DOCUMENTS

2018/0100659 A1* 4/2018 Yoshimura ..... F24F 1/18
2018/0164005 A1* 6/2018 Miyawaki ..... F25B 39/00

FOREIGN PATENT DOCUMENTS

JP 2004-251554 A 9/2004
JP 2004-271113 A 9/2004
(Continued)

OTHER PUBLICATIONS

Pdf is translation of foreign reference KR-20100097391-A (Year: 2010).*

*Primary Examiner* — Henry T Crenshaw
*Assistant Examiner* — Kamran Tavakoldavani
(74) *Attorney, Agent, or Firm* — Jefferson IP Law, LLP

(57) ABSTRACT

The present disclosure relates to a heat exchanger and an air conditioner including the same. The heat exchanger may be provided for heat exchange between refrigerant and air. The heat exchanger may include a plurality of refrigerant tubes that are disposed with a clearance (C) therebetween in a first direction (A), in which the air moves, and are disposed to be spaced apart in a second direction (B) crossing the first direction (A) and a plurality of heat exchange fins that are disposed between the plurality of refrigerant tubes disposed to be spaced apart in the second direction (B).

20 Claims, 16 Drawing Sheets

(51) Int. Cl.

| | |
|---|---|
| ***F25B 39/02*** | (2006.01) |
| ***F28F 1/12*** | (2006.01) |
| ***F28F 1/30*** | (2006.01) |
| ***F28F 17/00*** | (2006.01) |

(52) U.S. Cl.
CPC ..... *F28F 1/30* (2013.01); *F28F 17/00* (2013.01); *F25B 2339/0241* (2013.01); *F28F 2215/08* (2013.01)

(58) Field of Classification Search
USPC ..... 165/151
See application file for complete search history.

(56) References Cited

FOREIGN PATENT DOCUMENTS

| | | | | | |
|---|---|---|---|---|---|
| JP | 2004-317002 | A | | 11/2004 | |
| JP | 2005-069669 | A | | 3/2005 | |
| KR | 10-2004-0047603 | A | | 6/2004 | |
| KR | 10-2010-0097391 | A | | 9/2010 | |
| KR | 20100097391 | A | * | 9/2010 | ..... F28F 1/30 |

* cited by examiner

HEAT EXCHANGER AND AIR CONDITIONER INCLUDING SAME

CROSS-REFERENCE TO RELATED APPLICATION(S)

This application is a U.S. National Stage application under 35 U.S.C. § 371 of an International application number PCT/KR2019/010827, filed on Aug. 26, 2019, which is based on and claimed priority of a Japanese patent application number 2018-158691, filed on Aug. 27, 2018, in the Japanese Patent Office, the disclosure of each of which is incorporated by reference herein in its entirety.

TECHNICAL FIELD

The present disclosure relates to a heat exchanger and an air conditioner including the same.

BACKGROUND ART

Patent Document 1 discloses an evaporator including a plurality of refrigerant circulators disposed in parallel and corrugated fins, which are for use in evaporators, that are disposed between the refrigerant circulators adjacent to each other, wherein a drainage groove that vertically extends is formed in a central portion of the refrigerant circulator in a direction of ventilation, the corrugated fin consists of wave crest portions, wave trough portions, and connecting portions configured to connect the wave crest portions and the wave trough portions, a single valley portion is formed in a central portion of the connecting portion in the direction of ventilation, the corrugated fin is disposed so that a curved bottom portion of the valley portion of the connecting portion is placed at a position that corresponds to the drainage groove of the refrigerant circulator, and, in the connecting portion, an inclined portion inclined downward from an upstream end in the direction of ventilation toward the curved bottom portion of the valley portion and an inclined portion inclined downward from a downstream end in the direction of ventilation toward the curved bottom portion of the valley portion are provided.

Patent Document 1: Japanese Unexamined Patent Application Publication No. 2005-69669

DISCLOSURE

Technical Problem

When water condensed in a heat exchange fin of a heat exchanger stays in the heat exchange fin, ventilation resistance is increased, and thus the heat exchange ability is degraded. Accordingly, it is required to improve the drainage performance, which is the performance of discharging condensate water from the heat exchanger.

An object of the present disclosure is to improve the condensate water drainage performance.

Technical Solution

A heat exchanger according to an aspect of the present disclosure may be provided for heat exchange between refrigerant and air. The heat exchanger may include a plurality of refrigerant tubes that are disposed with a clearance (C) therebetween in a first direction (A), in which the air moves, and are disposed to be spaced apart in a second direction (B) crossing the first direction (A) and a plurality of heat exchange fins that are disposed between the plurality of refrigerant tubes disposed to be spaced apart in the second direction (B), wherein each of the plurality of heat exchange fins may include a first portion disposed at an upstream side in the first direction (A), a second portion disposed at a downstream side in the first direction (A), and a valley portion disposed between the first portion and the second portion in the first direction (A) so as to correspond to the clearance (C), each of the first portion and the second portion including a first inclined portion inclined upward toward the downstream side in the first direction (A) and a second inclined portion inclined downward toward the downstream side in the first direction (A).

The first portion and the second portion may be provided so that the first inclined portion of the first portion and the second inclined portion of the second portion face each other while the valley portion is disposed therebetween or the second inclined portion of the first portion and the first inclined portion of the second portion face each other while the valley portion is disposed therebetween.

The plurality of refrigerant tubes may include a first refrigerant tube disposed to correspond to the first portions of the plurality of heat exchange fins in the first direction (A) and a second refrigerant tube disposed to correspond to the second portions of the plurality of heat exchange fins in the first direction (A), and each of the plurality of heat exchange fins may further include an upstream side end portion, which extends toward the upstream side in the first direction (A) from the first portion thereof so as to be disposed at an upstream side that is higher than the first refrigerant tube in the first direction (A), and a downstream side end portion, which extends toward the downstream side in the first direction (A) from the second portion thereof so as to be disposed at a downstream side that is lower than the second refrigerant tube in the first direction (A).

A length of the upstream side end portion of each of the plurality of heat exchange fins that extends in the first direction (A) may be longer than a length of the downstream side end portion of each of the plurality of heat exchange fins that extends in the first direction (A).

Each of the plurality of heat exchange fins may further include a plurality of slits formed in the first portion and the second portion so as to be disposed side by side in the first direction (A).

The plurality of slits may include first slits formed in the first inclined portion of the first portion and the first inclined portion of the second portion and second slits formed in the second inclined portion of the first portion and the second inclined portion of the second portion, and the number of first slits may be less than the number of second slits.

A length of the first inclined portion of the first portion extending in the first direction (A) may be shorter than a length of the second inclined portion of the first portion extending in the first direction (A), and a length of the first inclined portion of the second portion extending in the first direction (A) may be shorter than a length of the second inclined portion of the second portion extending in the first direction (A).

Each of the plurality of heat exchange fins may further include standing fins formed in at least one of the first portion and the second portion so as to protrude upward or downward therefrom.

The standing fins may include a first standing fin that faces any one of the plurality of refrigerant tubes disposed to be spaced apart in the second direction (B) and a second standing fin that faces the other one of the plurality of refrigerant tubes disposed to be spaced apart in the second direction (B) and is disposed to be spaced apart from the first standing fin.

The first standing fin may include a first end portion that faces any one of the plurality of refrigerant tubes disposed to be spaced apart in the second direction (B) and a second end portion that is provided at the opposite side of the first end portion so as to face an inner side of the plurality of heat exchange fins and is disposed to be higher than the first end portion, and the second standing fin may include a first end portion that faces the other one of the plurality of refrigerant tubes disposed to be spaced apart in the second direction (B) and a second end portion that is provided at the opposite side of the first end portion so as to face the inner side of the plurality of heat exchange fins and is disposed to be higher than the first end portion.

The first standing fin and the second standing fin that are adjacent to each other in the second direction (B) may protrude in the same direction, which is either upward or downward from the plurality of heat exchange fins.

A portion of each of the plurality of heat exchange fins may be cut and bent upward or downward from each of the plurality of heat exchange fins so as to form the standing fin.

The plurality of heat exchange fins may be stacked at gaps (FP) in a third direction (F) crossing the first direction (A) and the second direction (B), each of the plurality of heat exchange fins may further include a peak portion provided in the first portion and the second portion so as to form a boundary between the first inclined portion and the second inclined portion, and a gap (G) between the valley portion and the peak portion in the third direction (F) may correspond to 0.3 to 1.0 times the gap (FP) between the plurality of heat exchange fins.

The plurality of heat exchange fins may include a first group provided to be inclined toward any one of the plurality of refrigerant tubes disposed to be spaced apart in the second direction (B) and a second group provided to be inclined toward the other one of the plurality of refrigerant tubes disposed to be spaced apart in the second direction (B).

An air conditioner according to an aspect of the present disclosure may include a heat exchanger provided for heat exchange between refrigerant and air. The heat exchanger may include a plurality of refrigerant tubes that are disposed with a clearance (G) therebetween in a first direction (A), in which the air moves, and are disposed to be spaced apart in a second direction (B) crossing the first direction (A) and a plurality of heat exchange fins that are disposed between the plurality of refrigerant tubes disposed to be spaced apart in the second direction (B), wherein each of the plurality of heat exchange fins may include a first inclined portion inclined upward toward a downstream side in the first direction (A) and a second inclined portion inclined downward toward the downstream side in the first direction (A), and the heat exchange performance of the heat exchanger may be different on the first inclined portion and the second inclined portion.

Each of the plurality of heat exchange fins may further include a plurality of slits formed in the first inclined portion and the second inclined portion so as to be disposed side by side in the first direction (A).

The plurality of slits may include first slits formed in the first inclined portion and second slits formed in the second inclined portion, and the number of first slits may be different from the number of second slits.

A length of the first inclined portion extending in the first direction (A) may be different from a length of the second inclined portion extending in the first direction (A).

Each of the plurality of heat exchange fins may further include a valley portion disposed between the first inclined portion and the second inclined portion and disposed to be lower than the first inclined portion and the second inclined portion.

The valley portion may be disposed between the first inclined portion and the second inclined portion in the first direction (A) so as to correspond to the clearance (G).

Advantageous Effects

According to the present disclosure, the condensate water drainage performance can be improved.

MODES OF THE INVENTION

Hereinafter, exemplary embodiments according to the present disclosure will be described in detail with reference to the accompanying drawings. Meanwhile, the terms used in the following description, such as "front end," "rear end," "upper portion," "lower portion," "upper end," and "lower end," have been defined on the basis of the drawings, and the shape and position of each element are not limited by the terms.

Hereinafter, a direction in which air moves will be defined as "first direction A," a direction crossing the first direction A will be defined as "second direction B," and a direction in which a plurality of heat exchange fins 2 are stacked will be defined as "third direction F." The third direction F may cross the first direction A and the second direction B. For reference, "ventilation direction A" refers to the same direction as the first direction A, "crossing direction B" refers to the same direction as the second direction B, and "height direction F" refers to the same direction as the third direction F.

Hereinafter, embodiments of the present disclosure will be described with reference to the accompanying drawings.

Figure 1:
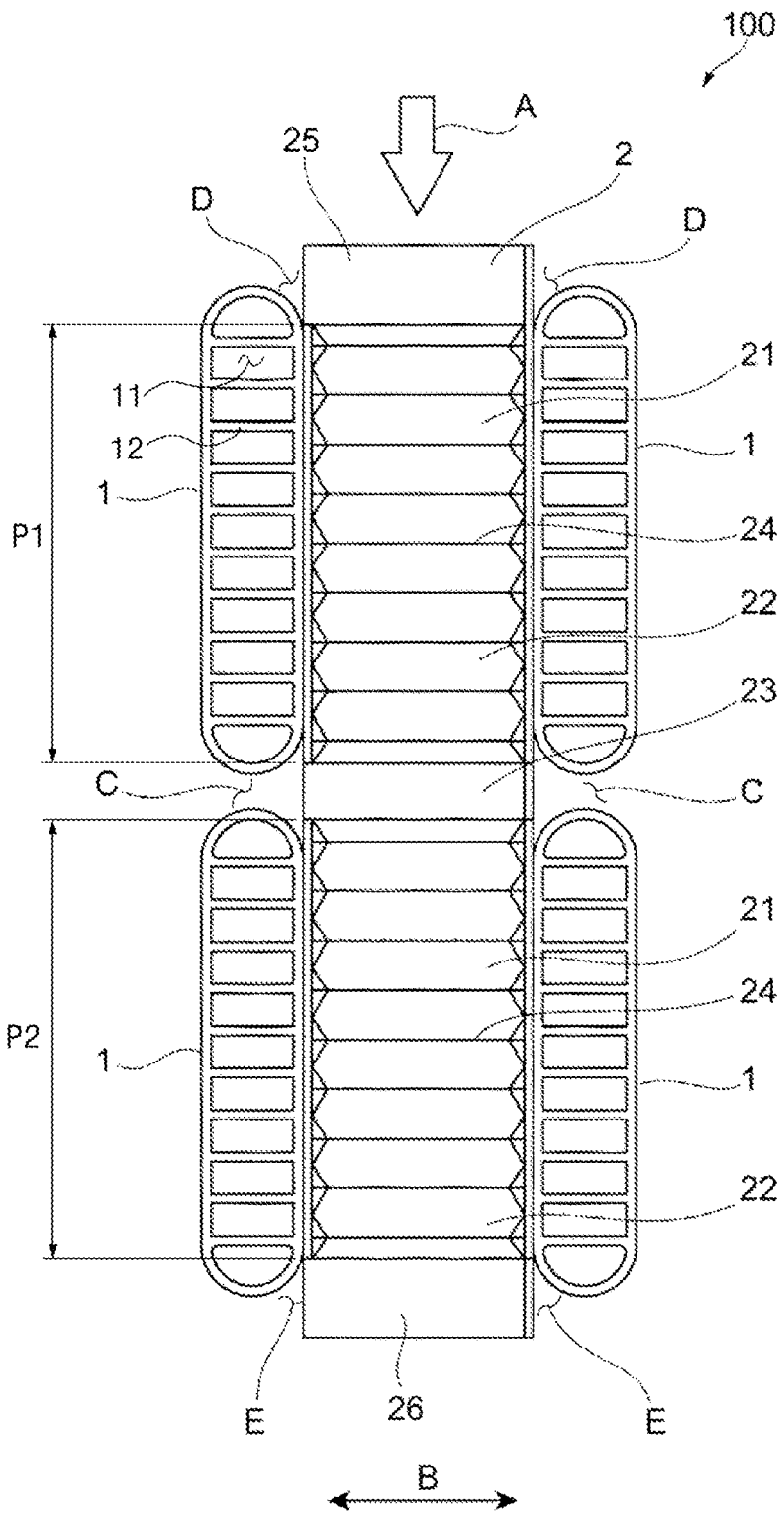
FIG. 1 is a plan view for describing a main part of a heat exchanger according to an embodiment of the present disclosure.

FIG. 1 is a plan view for describing a main part of a heat exchanger according to an embodiment of the present disclosure. In a heat exchanger 100, air flows in one direction due to an air blowing part (refer to an air blower 250 of FIG. 9) such as a fan, a direction in which the air flows is referred to as "ventilation direction A," and a direction crossing the ventilation direction A is referred to as "crossing direction B." For example, the heat exchanger 100 may be applied to an indoor unit or an outdoor unit of an air conditioner.

As illustrated in FIG. 1, the heat exchanger 100 may be provided for heat exchange between refrigerant and air. The heat exchanger 100 may include a refrigerant tube 1 longitudinally extending in the ventilation direction A and a heat exchange fin 2 having a shape that rises and falls in the ventilation direction A. In the present embodiment, the refrigerant tube 1 and the heat exchange fin 2 may be made of an aluminum material.

The refrigerant tube 1 may have a flat shape and be disposed to longitudinally extend in the ventilation direction A. The refrigerant tube 1 may be formed in a curved shape in which both end portions having a flat shape protrude outward. As illustrated in FIG. 1, the refrigerant tube 1 has a shape that is symmetrical in a longitudinal direction and is also symmetrical in a direction orthogonal to the longitudinal direction. Therefore, the heat exchanger 100 may be configured with one type of refrigerant tube 1. In this case, since the number of components may be reduced as compared to when the heat exchanger 100 is configured with multiple types of refrigerant tubes, the workability of assembling may be improved.

The refrigerant tube 1 is configured to allow a refrigerant to circulate therein. That is, a flow path 11 along which the refrigerant may flow may be provided inside the refrigerant tube 1, and the flow path 11 may be partitioned by a partition 12. As the refrigerant circulates in the refrigerant tube 1, the refrigerant tube 1 becomes cold, and the heat exchange fin 2 is also cooled. Therefore, the air in the ventilation direction A becomes cold as it passes through the heat exchange fin 2 and thus becomes cold air.

The refrigerant tube 1 is an example of a refrigerant circulator.

The heat exchanger 100 may include a plurality of refrigerant tubes 1.

The plurality of refrigerant tubes 1 may be provided to be spaced apart in the crossing direction B (first arrangement) or provided to be side by side in columns in the ventilation direction A (second arrangement). Here, the first arrangement may refer to a configuration in which the plurality of refrigerant tubes 1 are disposed in parallel in the ventilation direction A, and the second arrangement may be referred to as a configuration in which the plurality of refrigerant tubes 1 are disposed in series in the ventilation direction A.

In another aspect, the plurality of refrigerant tubes 1 may be disposed with a clearance C therebetween in the ventilation direction A and may be disposed to be spaced apart in the crossing direction B.

More specifically, in the present embodiment, two refrigerant tubes 1 are provided side by side in the ventilation direction A at one side of the heat exchange fin 2 in the crossing direction B, and two refrigerant tubes 1 may be provided side by side in the ventilation direction A also at the other side of the heat exchange fin 2. The clearance C may be present between the refrigerant tube 1 disposed at an upstream side in the ventilation direction A and the refrigerant tube 1 disposed at a downstream side in the ventilation direction A.

The heat exchange fin 2 may be installed between the plurality of refrigerant tubes 1 provided in the first arrangement. In other words, the heat exchange fin 2 may be disposed between the plurality of refrigerant tubes 1 disposed to be spaced apart in the crossing direction B. The heat exchange fin 2 may be connected to each of the four refrigerant tubes 1. In this way, the heat exchanger 100 may include the plurality of refrigerant tubes 1 disposed to be parallel and the heat exchange fin 2 disposed between the plurality of refrigerant tubes 1 adjacent to each other. The plurality of refrigerant tubes 1 may be disposed to be separated from each other in the ventilation direction A.

The four refrigerant tubes 1 may be configured to be coupled to the heat exchange fin 2 so that heat conduction occurs efficiently.

The heat exchanger 100 may include a plurality of heat exchange fins 2. Specifically, the heat exchanger 100 may include a plurality of heat exchange fins 2 stacked in the height direction F.

Each of the plurality of heat exchange fins 2 may include a first inclined portion 21 inclined upward toward the downstream side in the ventilation direction A and a second inclined portion 22 inclined downward toward the downstream side in the ventilation direction A. In the present embodiment, in the heat exchange fin 2, the first inclined portion 21, the second inclined portion 22, the first inclined portion 21, and the second inclined portion 22 may be sequentially disposed in this order from the upstream side toward the downstream side in the ventilation direction A.

Each of the plurality of heat exchange fins 2 may further include a valley portion 23 disposed between the second inclined portion 22 and the first inclined portion 21 disposed at a downstream side of the second inclined portion 22. The valley portion 23 may be disposed to be lower than the first inclined portion 21 and the second inclined portion 22. More specifically, a position of the valley portion 23 of the heat exchange fin 2 in the ventilation direction A may correspond to the clearance C between the plurality of refrigerant tubes 1 disposed side by side in columns. In other words, the valley portion 23 of the heat exchange fin 2 may be disposed between the second inclined portion 22 and the first inclined portion 21, which is disposed at the downstream side of the second inclined portion 22, so as to correspond to the clearance C between the plurality of refrigerant tubes 1. In the present embodiment, in the ventilation direction A, a length from the first inclined portion 21 of the heat exchange fin 2 to the second inclined portion 22 at the downstream side of the first inclined portion 21 may correspond to a length of the refrigerant tube 1.

Each of the plurality of heat exchange fins 2 may further include a peak portion 24 that forms a boundary between the first inclined portion 21 and the second inclined portion 22 and is disposed to be higher than the valley portion 23. In other words, each of the plurality of heat exchange fins 2 may further include the peak portion 24 that is formed between the first inclined portion 21 and the second inclined portion 22 disposed at a downstream side of the first inclined portion 21 and that is disposed at a position higher than the valley portion 23. In the present embodiment, heights of two peak portions 24 are the same in the height direction F (see FIGS. 2A and 2B).

Here, although the first inclined portion 21 is disposed at the most upstream side in the ventilation direction A in the present embodiment, the present disclosure is not limited thereto, and the second inclined portion 22 may also be disposed at the most upstream side. In this case, the clearance C may be disposed to correspond to the valley portion 23 disposed between the second inclined portion 22 at the most upstream side and the first inclined portion 21 disposed at the downstream side of the second inclined portion 22.

In another aspect, each of the plurality of heat exchange fins 2 may include a first portion P1 disposed at an upstream side in the ventilation direction A and a second portion P2 disposed at a downstream side in the ventilation direction A. Each of the first portion P1 and the second portion P2 may include the first inclined portion 21 inclined upward toward the downstream side in the ventilation direction A and the second inclined portion 22 inclined downward toward the downstream side in the ventilation direction A.

Each of the plurality of heat exchange fins 2 may further include a valley portion 23 disposed between the first portion P1 and the second portion P2 in the ventilation direction A so as to correspond to the clearance C.

The first portion P1 and the second portion P2 may be provided so that the first inclined portion 21 of the first portion P1 and the second inclined portion 22 of the second portion P2 face each other while the valley portion 23 is disposed therebetween or the second inclined portion 22 of the first portion P1 and the first inclined portion 21 of the second portion P2 face each other while the valley portion 23 is disposed therebetween. In the present embodiment, in each of the plurality of heat exchange fins 2, the first inclined portion 21 of the first portion P1, the second inclined portion 22 of the first portion P1, the valley portion 23, the first inclined portion 21 of the second portion P2, and the second inclined portion 22 of the second portion P2 may be sequentially disposed in this order from the upstream side toward the downstream side in the ventilation direction A. However, the order of arrangement of the first inclined portion 21 and the second inclined portion 22 of the first portion P1, the first inclined portion 21 and the second inclined portion 22 of the second portion P2, and the valley portion 23 is not limited to the above example. As an example, in each of the plurality of heat exchange fins 2, the second inclined portion 22 of the first portion P1, the first inclined portion 21 of the first portion P1, the valley portion 23, the second inclined portion 22 of the second portion P2, and the first inclined portion 21 of the second portion P2 may be sequentially disposed in this order from the upstream side toward the downstream side in the ventilation direction A. Each of the plurality of heat exchange fins 2 may further include a peak portion 24 that is provided in the first portion P1 and the second portion P2 to form a boundary between the first inclined portion 21 and the second inclined portion 22. Since the peak portion 24 has been described above, the description thereof will be omitted.

Meanwhile, the heat exchanger 100 illustrated in FIG. 1 only shows the minimum unit configuration, and as the plurality of refrigerant tubes 1, three or more refrigerant tubes 1 may be disposed side by side in columns in the ventilation direction A. In this case, the valley portion 23 is provided as a plurality of valley portions 23, and the clearance C between the refrigerant tubes 1 is present at a position of each valley portion 23 in the ventilation direction A. Therefore, the combination of the first inclined portion 21 and the second inclined portion 22 adjacent to the first inclined portion 21 and disposed downstream therefrom is provided to correspond to the number of refrigerant tubes 1, and the combinations are disposed side by side in columns.

Also, as an example of another configuration, the plurality of heat exchange fins 2 may be disposed side by side in the crossing direction B. In this case, for example, two columns of the plurality of refrigerant tubes 1 may be configured to be disposed between the plurality of heat exchange fins 2 disposed side by side in the crossing direction B, or a single column of the plurality of refrigerant tubes 1 may be disposed therebetween.

Figure 2A:
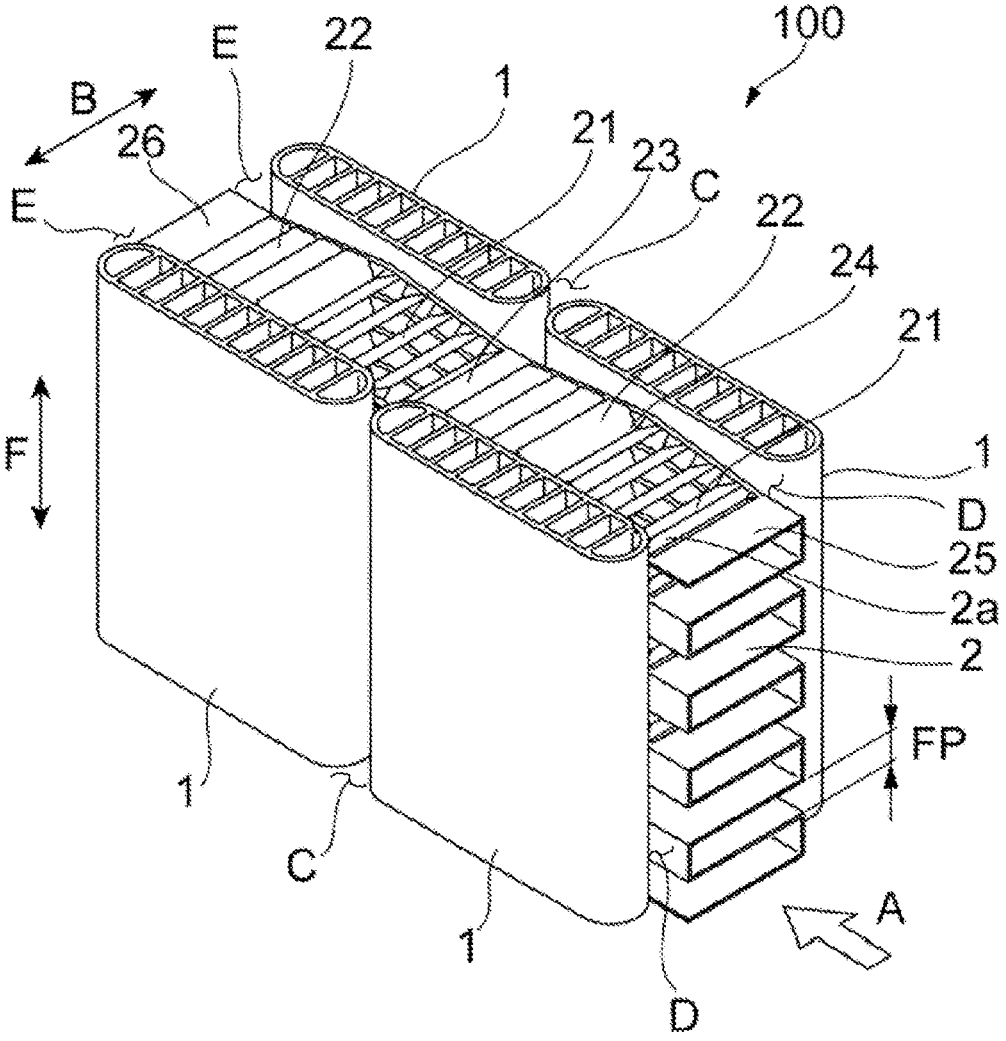
FIG. 2A is a perspective view illustrating an exterior of the heat exchanger according to an embodiment of the present disclosure.
Figure 2B:
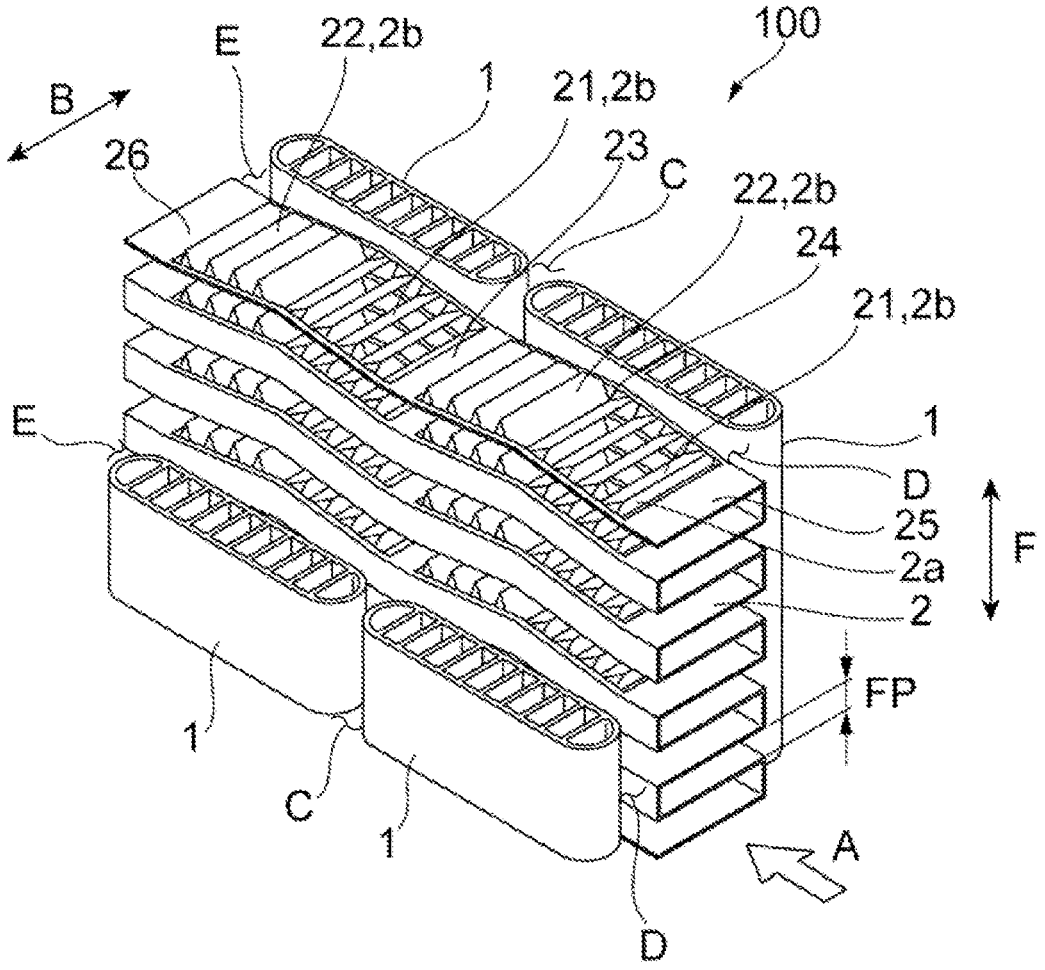
FIG. 2B is a perspective view illustrating the heat exchanger according to an embodiment of the present disclosure in a state in which a plurality of refrigerant tubes are partially cut out.
Figure 2C:
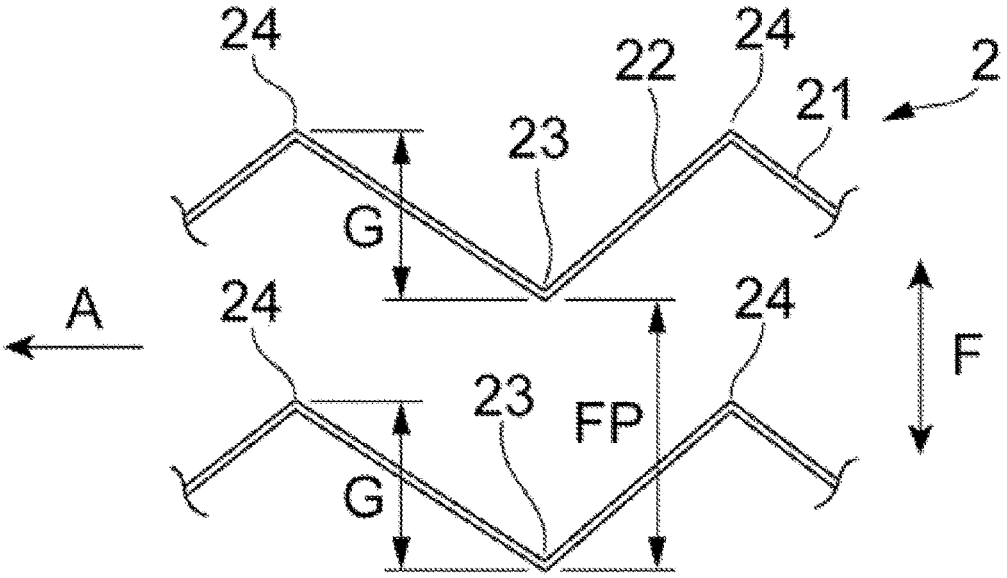
FIG. 2C is a schematic diagram for describing a size of a heat exchange fin in a height direction (F) in the heat exchanger according to an embodiment of the present disclosure.

FIG. 2A is a perspective view illustrating an exterior of the heat exchanger according to an embodiment of the present disclosure, and FIG. 2B is a perspective view illustrating the heat exchanger according to an embodiment of the present disclosure in a state in which a plurality of refrigerant tubes are partially cut out. FIG. 2C is a schematic diagram for describing the size of the heat exchange fin in the height direction F in the heat exchanger according to an embodiment of the present disclosure. In FIG. 2C, a standing fin 2*b* and a slit 2*a* have been omitted.

As illustrated in FIGS. 2A to 2C, the plurality of heat exchange fins 2 are formed in a wavy shape by bending a flat plate. More specifically, the plurality of heat exchange fins 2 are corrugated fins that are bent to be stacked in the height direction F. The heat exchange fins 2 are formed so that gaps between layers thereof or gaps FP between the layers thereof in the height direction F (see FIG. 2C) are equal.

In the present embodiment, the plurality of heat exchange fins 2 are formed as ten layers spaced apart from each other in the height direction F, but the present disclosure is not limited thereto. Also, the layers of the plurality of heat exchange fins 2 each have a shape that rises and falls in the ventilation direction A (wavy fins) and have the same shape. In the present embodiment, the layers are almost parallel.

As illustrated in FIGS. 2A and 2B, the slit 2*a* that is long in the crossing direction B is formed in the first inclined portion 21 and the second inclined portion 22 of the heat exchange fin 2 in the ventilation direction A. Also, the slit 2*a* of the heat exchange fin 2 is formed due to a portion made to stand after the flat plate is partially cut, that is, the standing fin 2*b*. The standing fin 2*b* extends longitudinally in the crossing direction B. Also, a plurality of standing fins 2*b* may be arranged side by side in the ventilation direction A. In the present embodiment, in the first inclined portion 21 disposed at the most upstream side in the ventilation direction A, the standing fin 2*b* is made to withstand air and thus allows air to be collected efficiently. Here, an example of a configuration in which the slit 2*a* is not formed may also be considered.

In another aspect, each of the plurality of heat exchange fins 2 may further include a plurality of slits 2*a* formed in the first portion P1 and the second portion P2 so as to be disposed side by side in the ventilation direction A. The plurality of slits 2*a* may be formed in the first inclined portion 21 and the second inclined portion 22 of the first portion P1 and the first inclined portion 21 and the second inclined portion 22 of the second portion P2 so as to be disposed side by side in the ventilation direction A.

Each of the plurality of heat exchange fins 2 may further include the standing fin 2*b* formed in at least one of the first portion P1 and the second portion P2 so as to protrude or extend upward or downward from the plurality of heat exchange fins 2. The standing fin 2*b* may be formed in at least one of the first inclined portion 21 of the first portion P1, the second inclined portion 22 of the first portion P1, the first inclined portion 21 of the second portion P2, and the second inclined portion 22 of the second portion P2. In a case in which the standing fin 2*b* is configured as a plurality of standing fins 2*b*, the plurality of standing fins 2*b* may be disposed side by side in the ventilation direction A. The standing fin 2*b* may be formed as each of the plurality of heat exchange fins 2 is partially cut and the cut portion is bent upward or downward from each of the plurality of heat exchange fins 2.

In the heat exchanger 100, when air flowing in the ventilation direction A becomes cold at the heat exchange fin 2, condensate or condensate water is generated at the heat exchange fin 2. The condensate water flows down along the first inclined portion 21 and the second inclined portion 22 of the heat exchange fin 2 and is gathered on the valley portion 23. The condensate water gathered at the valley portion 23 is dropped using the clearance C between the refrigerant tubes 1 so as to be discharged from the heat exchanger 100. More specifically, since the refrigerant tubes 1 adjacent to each other are disposed with the clearance C therebetween, the condensate water enters a space, which is formed due to outer circumferential surfaces of the refrigerant tubes 1, due to the action of surface tension and flows down from the space due to gravity.

In more detail, the space formed due to the clearance C between the refrigerant tubes 1 is an open space and is different from a closed space that may interfere with the discharge of condensate water due to the action of surface tension.

Also, in a case in which, from the first inclined portion 21 at the most upstream side, the condensate water flows down the first inclined portion 21 in a direction opposite to the ventilation direction A, the condensate water enters a clearance D (see FIG. 1) formed between the heat exchange fin 2 and the refrigerant tube 1 at the upstream side due to the action of surface tension and then exits the heat exchanger 100 over an outer surface of the refrigerant tube 1.

Also, in a case in which, from the second inclined portion 22 at the most downstream side, the condensate water flows down the second inclined portion 22 in the ventilation direction A, the condensate water enters a clearance E (see FIG. 1) formed between the heat exchange fin 2 and the refrigerant tube 1 at the downstream side due to the action of surface tension and then exits the heat exchanger 100 over an outer surface of the refrigerant tube 1.

In the present embodiment, the condensate water generated at the heat exchange fin 2 is gathered in the clearance C, the clearance D, and the clearance E through inclined surfaces and is caused to flow downward along the refrigerant tubes 1 due to gravity. That is, a flat upstream side end portion 25, which is disposed at an upstream end of the heat exchange fin 2 in the ventilation direction A, and a flat downstream side end portion 26, which is disposed at a downstream end of the heat exchange fin 2 in the ventilation direction A, protrude more than the refrigerant tubes 1. In other words, the plurality of refrigerant tubes 1 may include a first refrigerant tube disposed to correspond to the first portion P1 of the plurality of heat exchange fins 2 in the ventilation direction A and a second refrigerant tube disposed to correspond to the second portion P2 of the plurality of heat exchange fins 2 in the ventilation direction A. Each of the plurality of heat exchange fins 2 may further include the upstream side end portion 25, which extends from the first portion P1 of each of the plurality of heat exchange fins 2 toward the upstream side in the ventilation direction A so as to be disposed at a side that is further upstream than the first refrigerant tube in the ventilation direction A, and the downstream side end portion 26, which extends from the second portion P2 of each of the plurality of heat exchange fins 2 toward the downstream side in the ventilation direction A so as to be disposed at a side that is further downstream than the second refrigerant tube in the ventilation direction A. The above-mentioned clearance D may be formed between the upstream side end portion 25 and the refrigerant tube 1, and the above-mentioned clearance E may be formed between the downstream side end portion 26 and the refrigerant tube 1.

As a result, since the drainage performance of the heat exchange fin 2 is improved and ventilation resistance is decreased, degradation in the heat exchange ability due to condensate water may be suppressed. Although the number of sites at which the condensate water is gathered is three in the present embodiment, the number may also be another number.

In the present embodiment, the drainage system for removing the condensate water, which is generated as the air flowing in the ventilation direction A becomes cold due to the heat exchange fin 2, from the heat exchanger 100 is formed as described above. Therefore, for example, even when irregularities are not provided on the refrigerant tubes 1, a discharge path for condensate water may be formed. Also, when the drainage system according to the present embodiment is employed, the exterior of the heat exchanger 100 may become more compact while the performance of the heat exchanger 100 is maintained.

As illustrated in FIG. 2C, the heat exchange fins 2 are configurations stacked in the vertical direction, and a distance at which the heat exchange fins 2 are vertically spaced apart is the gap FP. That is, the plurality of heat exchange fins 2 may be stacked apart by the gaps FP in the height direction F. A distance between the valley portion 23 and the peak portion 24 of the heat exchange fin 2 in the height direction F is a gap G. The gap G may be a height difference between the second inclined portions 22 or may be a height difference between the first inclined portions 21.

Here, in the present embodiment, the heat exchange fins 2 are formed so that the gap G between the valley portion 23 and the peak portion 24 in the height direction F is a predetermined ratio to the gap FP.

Hereinafter, this will be described in detail with reference to FIGS. 3A and 3B.

Figure 3A:
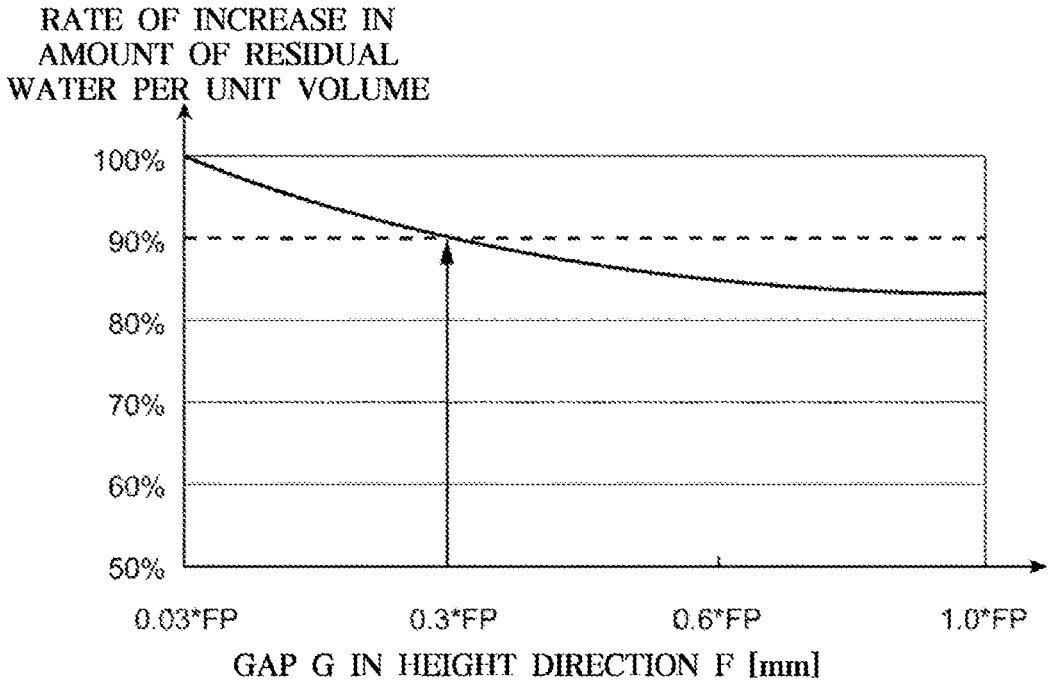
FIGS. 3A and 3B are graphs for describing optimization of a gap (G) between a valley portion and a peak portion in the height direction (F) in the heat exchanger according to an embodiment of the present disclosure.
Figure 3B:
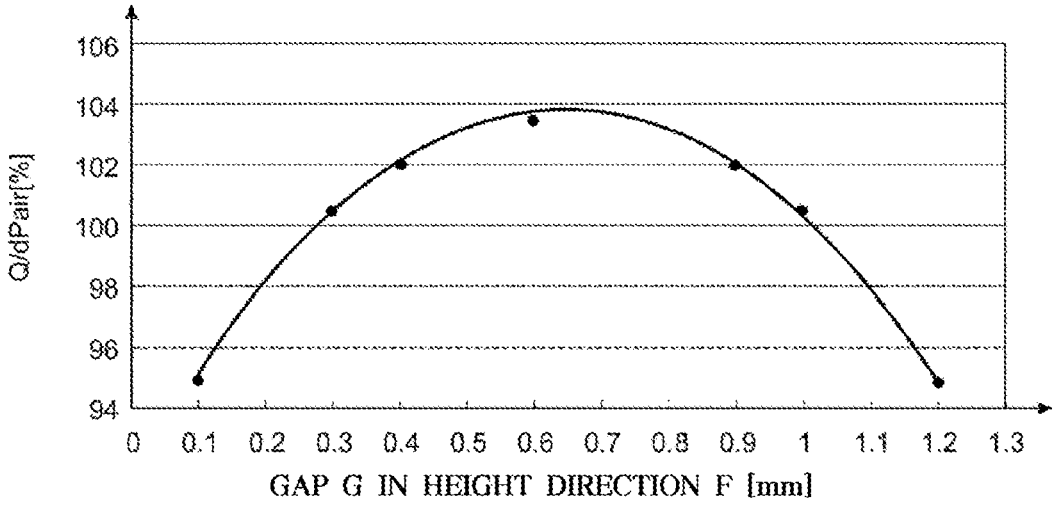

FIGS. 3A and 3B are graphs for describing optimization of the gap G between the valley portion and the peak portion in the height direction F in the heat exchanger according to an embodiment of the present disclosure. FIG. 3A shows a graph for describing the relationship between the gap G and the amount of residual water, in which the vertical axis represents a rate of increase in the amount of residual water, which is the amount of condensate water remaining in the heat exchange fins 2 per unit volume, and the horizontal axis represents a ratio of the gap G to the gap FP (mm) FIG. 3B shows a graph for describing the relationship between the gap G and the performance, in which the vertical axis represents a ratio (%) of Q (the amount of heat exchanged) to dPair (ventilation resistance), and the horizontal axis represents the ratio of the gap G to gap FP (mm) as in FIG. 3A. Conventionally, the rate of increase in the amount of residual water is 90% in FIG. 3A (see dotted line), and the ratio of Q to dPair is 100% in FIG. 3B.

In the present embodiment, the gap G between the valley portion 23 and the peak portion 24 in the height direction F is formed to have a value within a range of 0.3 to 1.0 times the gap FP.

When the gap G in the height direction F is less than or equal to 0.29 times the gap FP, as can be seen from the graph of FIG. 3A, the amount of residual water in the heat exchange fins 2 is large, and as can be seen from the graph of FIG. 3B, the value of Q/dPair is less than 100%. Therefore, in the case in which the gap G is less than or equal to 0.29 times the gap FP, the ventilation resistance is increased, and the heat exchange ability is degraded.

Also, when the gap G in the height direction F is greater than or equal to 1.1 times the gap FP, the amount of residual water in the heat exchange fins 2 is small, but as can be seen from the graph of FIG. 3B, the value of Q/dPair is less than 100%. Therefore, since the ventilation resistance is higher than the amount of heat exchanged or the heat transfer performance, the heat exchange ability is degraded.

In this way, when the gap G is set to have a value within the range of 0.3 to 1.0 times the gap FP, as compared to when a value deviating from the range is employed as the gap G, the amount of residual water in the heat exchange fins 2 is decreased, and the degradation in the heat exchange ability may be suppressed.

Also, when the gap G between the valley portion 23 and the peak portion 24 has a value within a range of 0.4 to 0.9 times the gap FP, since the ratio of the amount of heat exchanged to the ventilation resistance is further increased, it is preferable. In more detail, suitably, the gap G is set to be 0.6 times the gap FP.

Since, conventionally, the rate of increase in the amount of residual water that is shown in FIG. 3A is about 90%, and the value of Q/dPair that is shown in FIG. 3B is about 100%, as compared to the conventional case, the amount of residual water is decreased and the heat exchange ability is improved in the present embodiment.

Next, another embodiment configured on the basis of the heat exchanger 100 according to the present embodiment will be described.

Figure 4A:
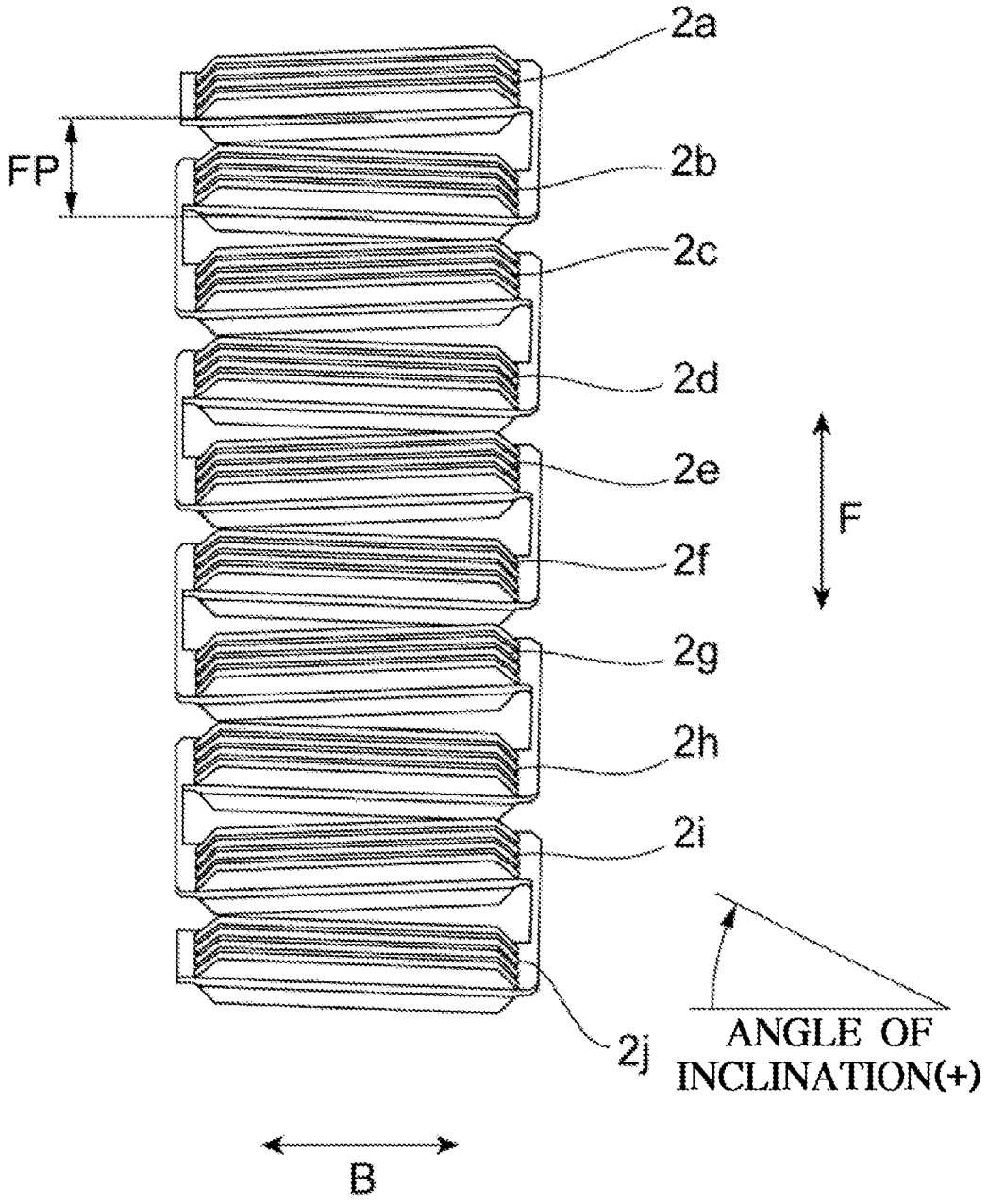
FIGS. 4A and 4B are views for describing heat exchange fins of a heat exchanger according to another embodiment of the present disclosure.
Figure 4B:
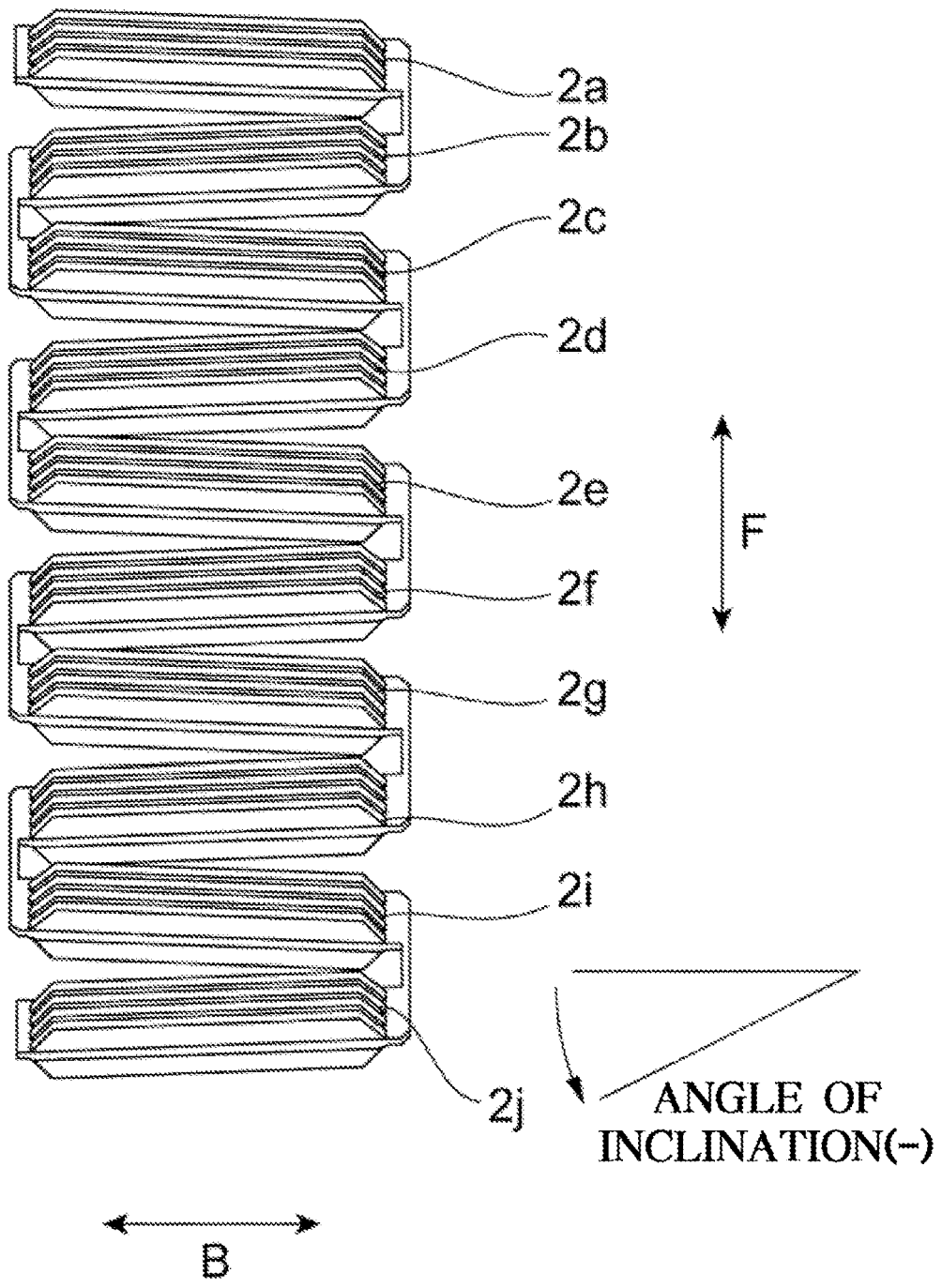

FIGS. 4A and 4B are views for describing heat exchange fins of a heat exchanger according to another embodiment of the present disclosure. FIGS. 4A and 4B illustrate heat exchange fins viewed from the upstream side to the downstream side in the ventilation direction A. FIGS. 4A and 4B illustrate different embodiments. In a plurality of heat exchange fins 2 formed as ten layers, the uppermost layer is referred to as a first layer 2*a*, and layers below the first layer 2*a* are sequentially referred to as a second layer 2*b* to a tenth layer 2*j*. Also, for convenience of description, the ten layers of the plurality of heat exchange fins 2 will be divided into two groups, in which the first layer 2*a*, the third layer 2*c*, the fifth layer 2*e*, the seventh layer 2*g*, and the ninth layer 2*i* constitute a first group, and the second layer 2*b*, the fourth layer 2*d*, the sixth layer 2*f*, the eighth layer 2*h*, and the tenth layer 2*j* constitute a second group. Each of the layers 2*a* to 2*j* includes the first inclined portion 21, the second inclined portion 22, the valley portion 23, and the peak portion 24 that have been described above.

In the embodiments illustrated in FIGS. 4A and 4B, the first layer 2*a* to the tenth layer 2*j* of the plurality of heat exchange fins 2 are inclined with respect to the crossing direction B. In another aspect, the plurality of heat exchange fins 2 may include the first group provided to be inclined toward any one of the plurality of refrigerant tubes 1 disposed to be spaced apart in the crossing direction B and the second group provided to be inclined toward the other one of the plurality of refrigerant tubes 1 disposed to be spaced apart in the crossing direction B. Specifically, in an example illustrated in FIG. 4A, the plurality of heat exchange fins 2 constituting the first group are inclined downward toward the left, and the plurality of heat exchange fins 2 constituting the second group are inclined downward toward the right. That is, the first inclined portion 21, the second inclined portion 22, the valley portion 23, and the peak portion 24 are inclined downward toward the left in the first group and are inclined downward toward the right in the second group. Therefore, a direction in which the condensate water gathered at the valley portion 23 flows is set, and thus the condensate water may be promptly discharged from the valley portion 23 to the clearance C. Likewise, since the direction is set also with respect to the clearances D and E, the condensate water may be promptly discharged thereto.

In this way, since angles of inclination of the plurality of heat exchange fins 2 are formed to be positive with respect to the horizontal toward the plurality of refrigerant tubes 1 disposed to be parallel, the condensate water flows toward the plurality of refrigerant tubes 1 and flows downward along the plurality of refrigerant tubes 1 due to gravity. Therefore, the drainage performance of the plurality of heat exchange fins 2 may be improved, and the ventilation resistance may be reduced to improve the heat exchange ability.

Also, in the case of another embodiment illustrated in FIG. 4B, the plurality of heat exchange fins 2 may also be inclined in the opposite direction as compared to the case of FIG. 4A. That is, angles of inclination of the plurality of heat exchange fins 2 may also be negative toward the plurality of refrigerant tubes 1 disposed to be parallel.

Figure 5A:
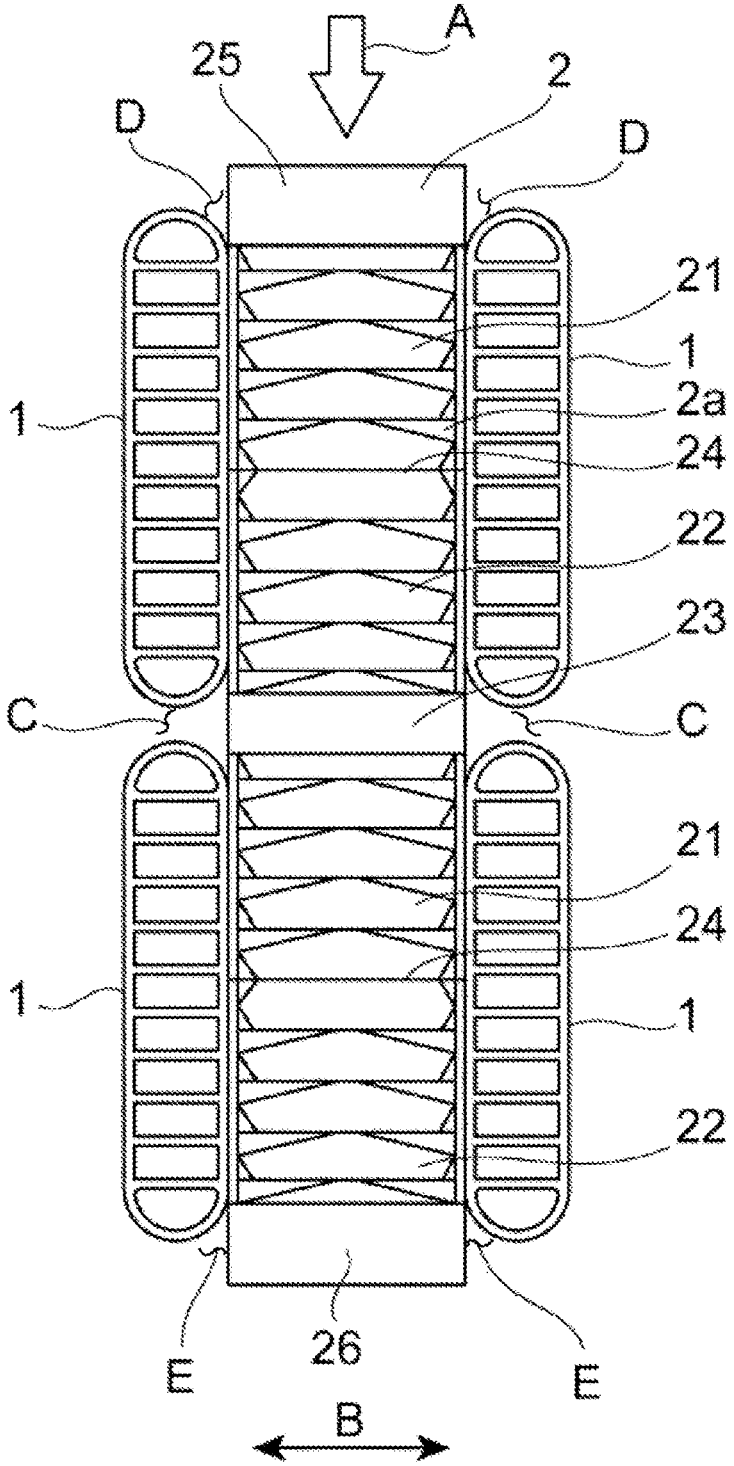
FIG. 5A is a plan view of a heat exchanger according to still another embodiment of the present disclosure.
Figure 5B:
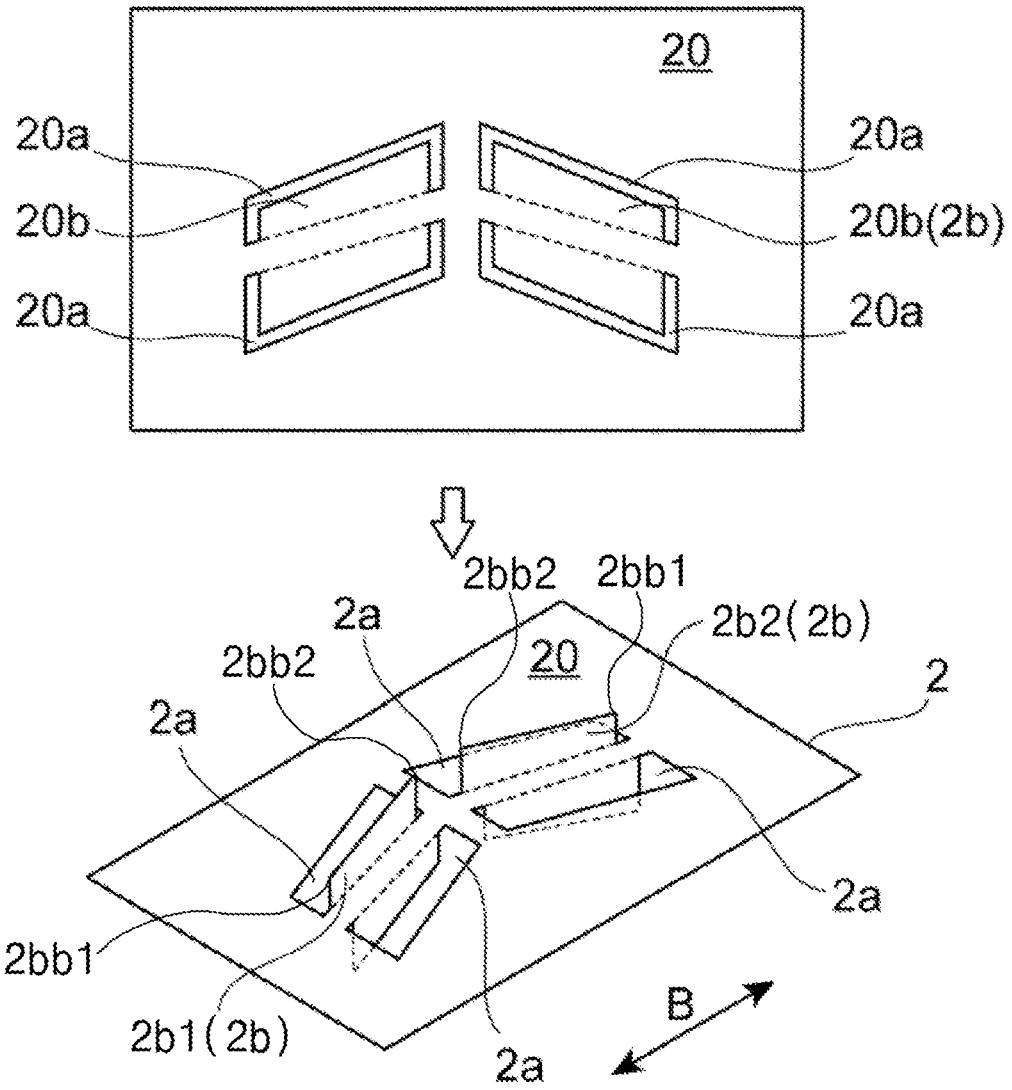
FIG. 5B is a view for describing a method of manufacturing heat exchange fins of the heat exchanger according to still another embodiment of the present disclosure.

FIG. 5A is a plan view of a heat exchanger according to still another embodiment of the present disclosure, and FIG. 5B is a view for describing a method of manufacturing heat exchange fins of the heat exchanger according to still another embodiment of the present disclosure.

As illustrated in FIGS. 5A and 5B, the standing fin 2*b* may include a first standing fin 2*b*1 that faces any one of the plurality of refrigerant tubes 1 disposed to be spaced apart in the crossing direction B and a second standing fin 2*b*2 that faces the other one of the plurality of refrigerant tubes 1 disposed to be spaced apart in the crossing direction B and is disposed to be spaced apart from the first standing fin 2*b*1. The first standing fin 2*b*1 and the second standing fin 2*b*2 may be disposed to be spaced apart from each other in the crossing direction B.

The first standing fin 2*b*1 may include a first end portion 2*bb*1 that faces any one of the plurality of refrigerant tubes 1 disposed to be spaced apart in the crossing direction B and a second end portion 2*bb*2 that is provided at the opposite side of the first end portion 2*bb*1 so as to face an inner side of the plurality of heat exchange fins 2 and that is disposed to be higher than the first end portion 2*bb*1. The second standing fin 2*b*2 may include a first end portion 2*bb*1 that faces the other one of the plurality of refrigerant tubes 1 disposed to be spaced apart in the crossing direction B and a second end portion 2*bb*2 that is provided at the opposite side of the first end portion 2*bb*1 so as to face the inner side of the plurality of heat exchange fins 2 and that is disposed to be higher than the first end portion 2*bb*1.

The first standing fin 2*b*1 and the second standing fin 2*b*2 that are adjacent to each other in the crossing direction B may protrude or extend in the same direction, which is either upward or downward from the plurality of heat exchange fins 2.

In the heat exchanger 100 illustrated in FIG. 5A, the slit 2*a* of the heat exchange fin 2 is formed in an upside-down V-shape. The standing fin 2*b* that is cut and made to stand due to the slit 2*a* is also formed in the upside-down V-shape. Upper ends of the standing fin 2*b* extend to be inclined downward from the center toward both sides in the crossing direction B, and the center of the standing fin 2*b* is at a high position, and both ends thereof are at lower positions. Due to setting the directions in this way, the condensate water generated in the heat exchange fin 2 flows toward the refrigerant tube 1 in the directions of inclination due to the upside-down V-shaped slit 2*a*. Since a distance to the refrigerant tube 1 in the crossing direction B is shorter as compared to the cases illustrated in FIGS. 4A and 4B, a distance that the condensate water generated in the heat exchange fin 2 travels to reach the refrigerant tube 1 is shorter, and thus the drainage performance of the heat exchange fin 2 may be improved.

An inclined surface at one side upper end of the standing fin 2*b* is an example of a portion inclined toward one side end portion in the crossing direction B, and an inclined surface at the other side upper end thereof is an example of a portion inclined toward the other side end portion in the crossing direction B.

As an example of manufacturing the standing fin 2*b* due to the upside-down V-shaped slit 2*a*, as illustrated in FIG. 5B, two sets of angular C-shaped cuts 20*a* that face each other are formed in order to form a single upside-down V-shaped slit 2*a* in a flat plate 20, and a region 20*b* surrounded by each set of cuts 20*a* is cut in the same direction and made to stand. Then, the standing fin 2*b* illustrated in FIG. 5A is formed.

In the manufacturing example illustrated in FIG. 5B, the peak of the upside-down V-shape is divided in the crossing direction B, but the peak may also not be divided.

Figure 6A:
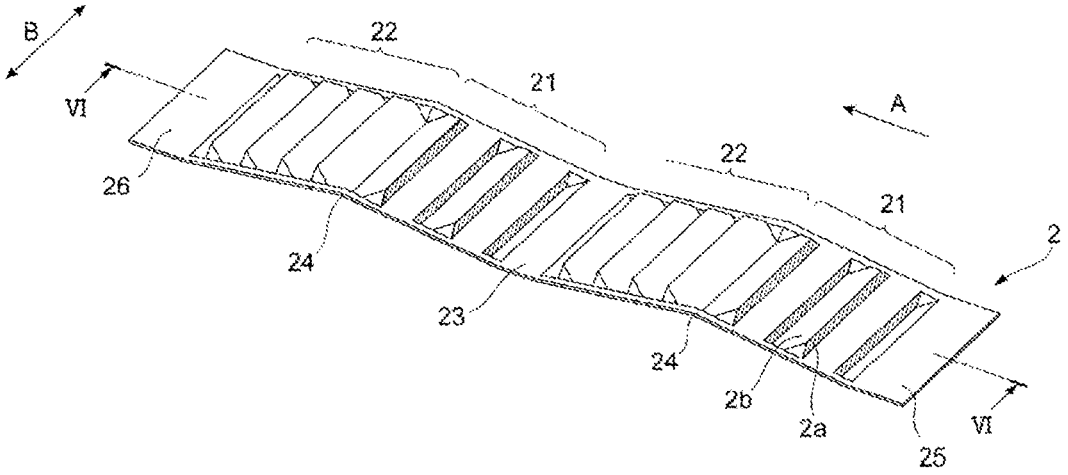
FIG. 6A is a perspective view for describing heat exchange fins of a heat exchanger according to yet another embodiment of the present disclosure.
Figure 6B:
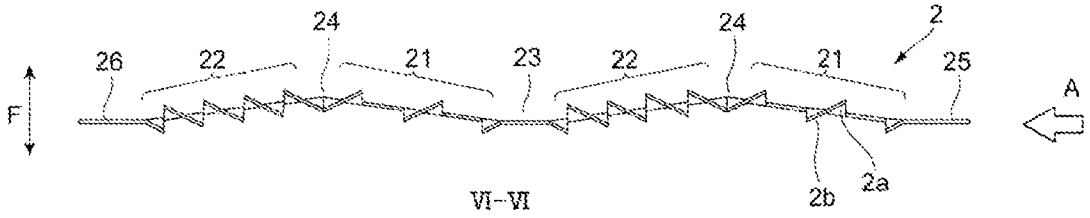
FIG. 6B is a cross-sectional view of the heat exchange fins illustrated in FIG. 6A that is taken along line VI-VI of FIG. 6A.

FIG. 6A is a perspective view for describing heat exchange fins of a heat exchanger according to yet another embodiment of the present disclosure, and FIG. 6B is a cross-sectional view of the heat exchange fins illustrated in FIG. 6A that is taken along line VI-VI of FIG. 6A. In FIG. 6A, regions of the slits 2*a* are indicated by diagonal lines.

In the heat exchange fins 2 illustrated in FIGS. 6A and 6B, the number of slits 2*a* formed in the first inclined portion 21 and the number of slits 2*a* formed in the second inclined portion 22 are different from each other. In FIGS. 6A and 6B, the number of slits 2*a* in the first inclined portion 21 is less than the number of slits 2*a* in the second inclined portion 22. In another aspect, the plurality of slits 2*a* may include first slits formed in the first inclined portion 21 and second slits formed in the second inclined portion 22, and the number of first slits and the number of second slits may be different from each other. Specifically, the number of first slits may be less than the number of second slits. In still another aspect, the plurality of slits 2*a* may include first slits formed in the first inclined portion 21 of the first portion P1 and the first inclined portion 21 of the second portion P2 and second slits formed in the second inclined portion 22 of the first portion P1 and the second inclined portion 22 of the second portion P2, and the number of first slits and the number of second slits may be different from each other. Specifically, the number of first slits may be less than the number of second slits. In the present embodiment, in the first inclined portion 21, three standing fins 2*b* are formed, and three sets of slits 2*a* are formed due to the standing fins 2*b*. On the other hand, in the second inclined portion 22, four standing fins 2*b* are formed, and thus four sets of slits 2*a* are formed.

The number of slits 2*a* mentioned herein corresponds to the number of standing fins 2*b*. Although two slits 2*a* are formed due to a single standing fin 2*b*, for the standing fins 2*b* at the lowest position 2*y* and the highest position 2*z*, a single slit 2*a* is formed due to a single standing fin 2*b* in consideration of a flow of condensate water. In FIGS. 6A and 6B, the lowest position 2*y* may refer to one portion of the second inclined portion 22 that is adjacent to the downstream side end portion 26, one portion of the first inclined portion 21 that is adjacent to the upstream side end portion 25, and one portion of the first inclined portion 21 and one portion of the second inclined portion 22 that are adjacent to the valley portion 23. In FIGS. 6A and 6B, the highest position 2*z* may refer to one portion of the first inclined portion 21 and one portion of the second inclined portion 22 that are adjacent to the peak portion 24. At the highest position 2*z*, a single slit 2*a* formed in one portion of the first inclined portion 21 that is adjacent to the peak portion 24 may face a single slit 2*a* formed in one portion of the second inclined portion 22 that is adjacent to the peak portion 24.

Here, generally, as the number of slits 2*a* increases, the heat exchange performance is improved, and the amount of generated condensate water is increased. In the configurations illustrated in FIGS. 6A and 6B, the number of slits 2*a* in the first inclined portion 21 facing the peak portion 24 in the ventilation direction A is less than the number of slits 2*a* in the second inclined portion 22 facing the valley portion 23 in the ventilation direction A. In this way, since the number of slits 2*a* in the first inclined portion 21 is less than that in the second inclined portion 22, the heat exchange performance of the first inclined portion 21 is different from the heat exchange performance of the second inclined portion 22. In the present embodiment, the heat exchange performance of the first inclined portion 21 is inferior to that of the second inclined portion 22. Therefore, since the amount of condensate water generated at the first inclined portion 21 is less than the amount of condensate water generated at the second inclined portion 22, which is a region from the peak portion 24 to the valley portion 23, the ventilation resistance may be lowered, and the heat exchange ability may be improved.

Figure 7A:
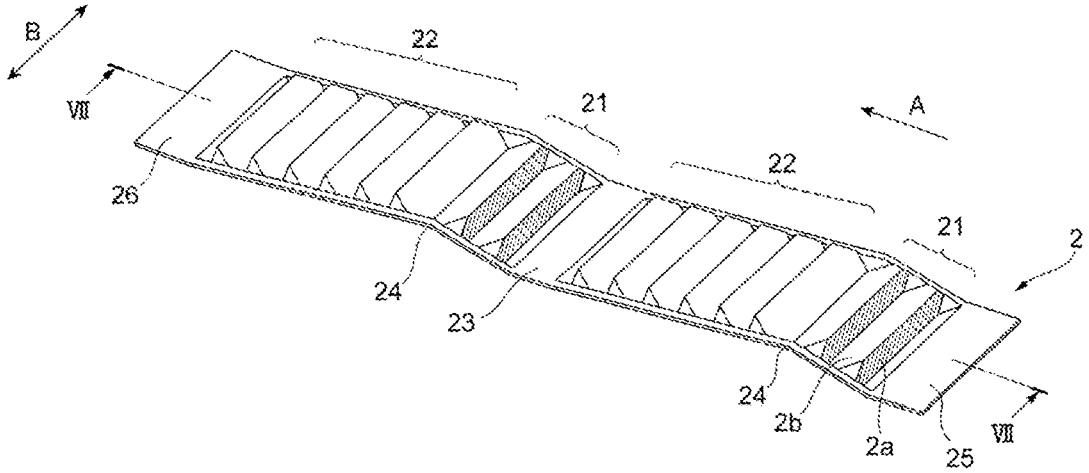
FIG. 7A is a perspective view illustrating heat exchange fins of a heat exchanger according to yet another embodiment of the present disclosure.
Figure 7B:
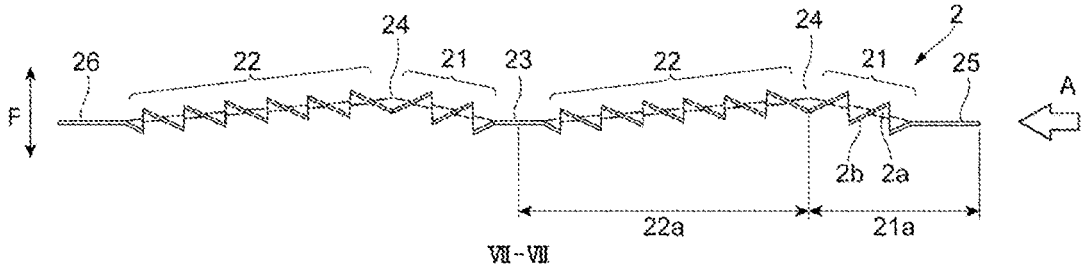
FIG. 7B is a cross-sectional view of the heat exchange fins illustrated in FIG. 7A that is taken along line VII-VII of FIG. 7A.

FIG. 7A is a perspective view illustrating heat exchange fins of a heat exchanger according to yet another embodiment of the present disclosure, and FIG. 7B is a cross-sectional view of the heat exchange fins illustrated in FIG. 7A that is taken along line VII-VII of FIG. 7A. In FIG. 7A, regions of the slits 2*a* are indicated by diagonal lines.

In the heat exchange fins 2 illustrated in FIGS. 7A and 7B, a length 21*a* of the first inclined portion 21 and the upstream side end portion 25 in the ventilation direction A and a length 22*a* of the second inclined portion 22 in the ventilation direction A are different from each other. In FIGS. 7A and 7B, the length 21*a* of the first inclined portion 21 etc. is shorter than the length 22*a* of the second inclined portion 22. In this way, the length 21*a*, which is the overall length of the first inclined portion 21 and the upstream side end portion 25 facing the peak portion 24 in the ventilation direction A, is shorter than the length 22*a* of the second inclined portion 22 facing the valley portion 23 in the ventilation direction A. In another aspect, a length of the first inclined portion 21 extending in the ventilation direction A may be different from a length of the second inclined portion 22 extending in the ventilation direction A. Specifically, the length of the first inclined portion 21 extending in the ventilation direction A may be shorter than the length of the second inclined portion 22 extending in the ventilation direction A. In still another aspect, a length of the first inclined portion 21 of the first portion P1 extending in the ventilation direction A may be shorter than a length of the second inclined portion 22 of the first portion P1 extending in the ventilation direction A, and a length of the first inclined portion 21 of the second portion P2 extending in the ventilation direction A may be shorter than a length of the second inclined portion 22 of the second portion P2 extending in the ventilation direction A.

The present embodiment is not limited thereto, and the length of the first inclined portion 21 facing the peak portion 24 in the ventilation direction A may also be shorter than the length of the second inclined portion 22 facing the valley portion 23 in the ventilation direction A.

Here, generally, as the length in the ventilation direction A increases, the heat transfer area increases such that the heat exchange performance is improved, and the amount of generated condensate water is increased. In the configurations illustrated in FIGS. 7A and 7B, the length of the first inclined portion 21 etc. is shorter than that of the second inclined portion 22. In this way, since the length of the first inclined portion 21 etc. is shorter, the heat transfer area therein is reduced such that the heat exchange performance therein is degraded. Therefore, since the amount of condensate water generated at the first inclined portion 21 etc. is less than the amount of condensate water generated at the second inclined portion 22, which is the region from the peak portion 24 to the valley portion 23, the ventilation resistance may be lowered, and the heat exchange ability may be improved.

The configuration example illustrated in FIGS. 7A and 7B is the same as the case illustrated in FIGS. 6A and 6B in that the number of slits 2*a* or the number of standing fins 2*b* is different in the first inclined portion 21 and the second inclined portion 22. However, the configuration example illustrated in FIGS. 7A and 7B is different from the case illustrated in FIGS. 6A and 6B, in which the lengths of the first inclined portion 21 and the second inclined portion 22 are the same, in that the lengths are different from each other.

In any of the case illustrated in FIGS. 6A and 6B and the case illustrated in FIGS. 7A and 7B, the heat exchange performance is degraded in the first inclined portion 21 as compared to that in the second inclined portion 22, and thus, the amount of condensate water generated in the first inclined portion 21 is less than the amount of condensate water generated in the second inclined portion 22 such that the ventilation resistance is lowered. The degradation of the heat exchange performance of the first inclined portion 21 is realized by the number of slits 2*a* or the number of standing fins 2*b* in the case of FIGS. 6A and 6B and is realized by the lengths of the first inclined portion 21 and the second inclined portion 22 in the case of FIGS. 7A and 7B.

Figure 8:
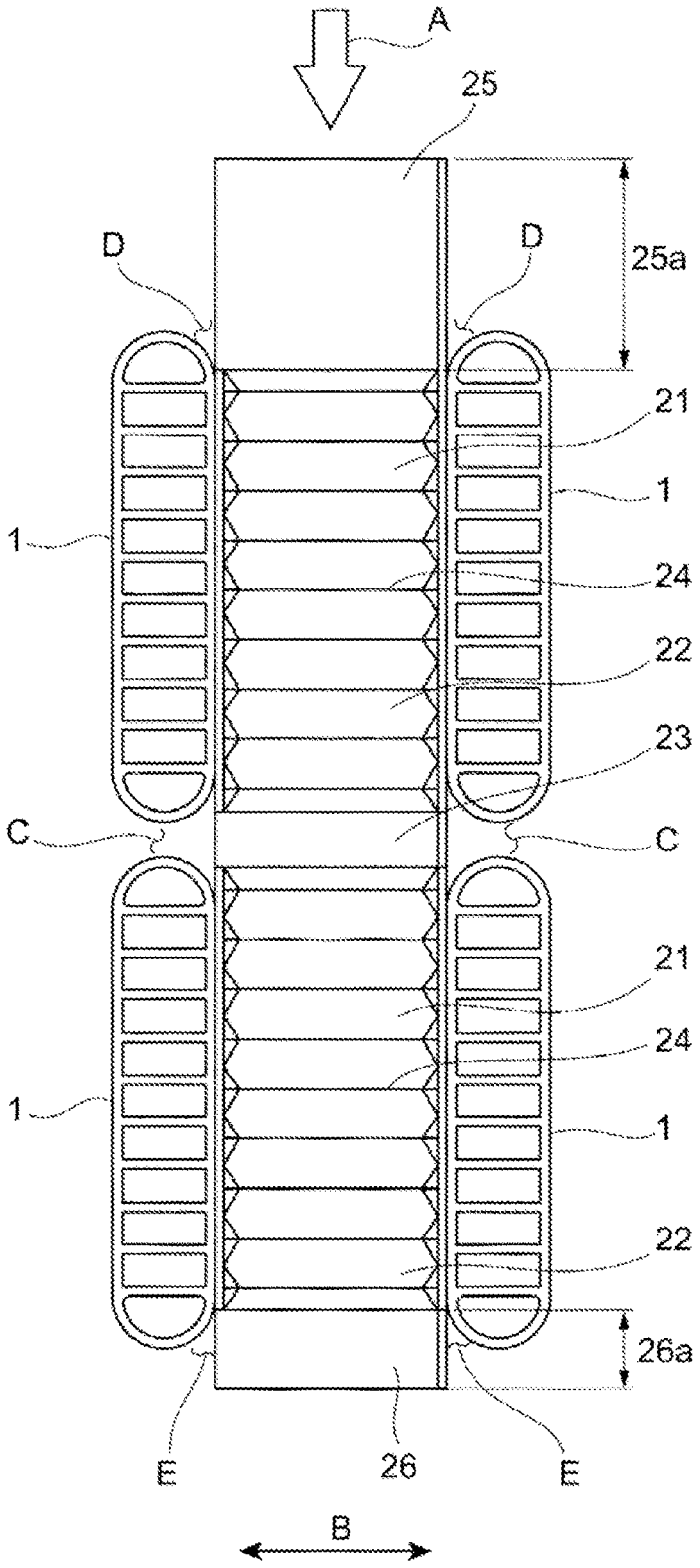
FIG. 8 is a plan view illustrating a heat exchanger according to yet another embodiment of the present disclosure.

FIG. 8 is a plan view illustrating a heat exchanger according to yet another embodiment of the present disclosure.

In the heat exchange fin 2 of the heat exchanger 100 illustrated in FIG. 8, the upstream side end portion 25 is formed to be long at an upstream side in the ventilation direction A. More specifically, a length 25*a* of the upstream side end portion 25 is formed to be longer than a length 26*a* of the downstream side end portion 26 in the ventilation direction A. In other words, the length 25*a* of the upstream side end portion 25 of each of the plurality of heat exchange fins 2 extending in the ventilation direction A may be longer than the length 26*a* of the downstream side end portion 26 of each of the plurality of heat exchange fins 2 extending in the ventilation direction A.

Therefore, since an upstream end of the upstream side end portion 25 is spaced apart from the refrigerant tube 1, condensate water may be prevented from freezing at the upstream end. The freezing of the condensate water at the upstream end of the upstream side end portion 25 adversely affects the flow of air in the ventilation direction A and thus is not preferable. In the case of FIG. 8, the heat exchange performance at the upstream side end portion 25 may be degraded so that the amount of generated condensate water is suppressed and the ventilation resistance is lowered at the upstream side end portion 25. In this way, the heat exchange ability may be improved.

Next, an air conditioner 1000 to which the heat exchanger 100 according to the present embodiment is applied will be described.

Figure 9:
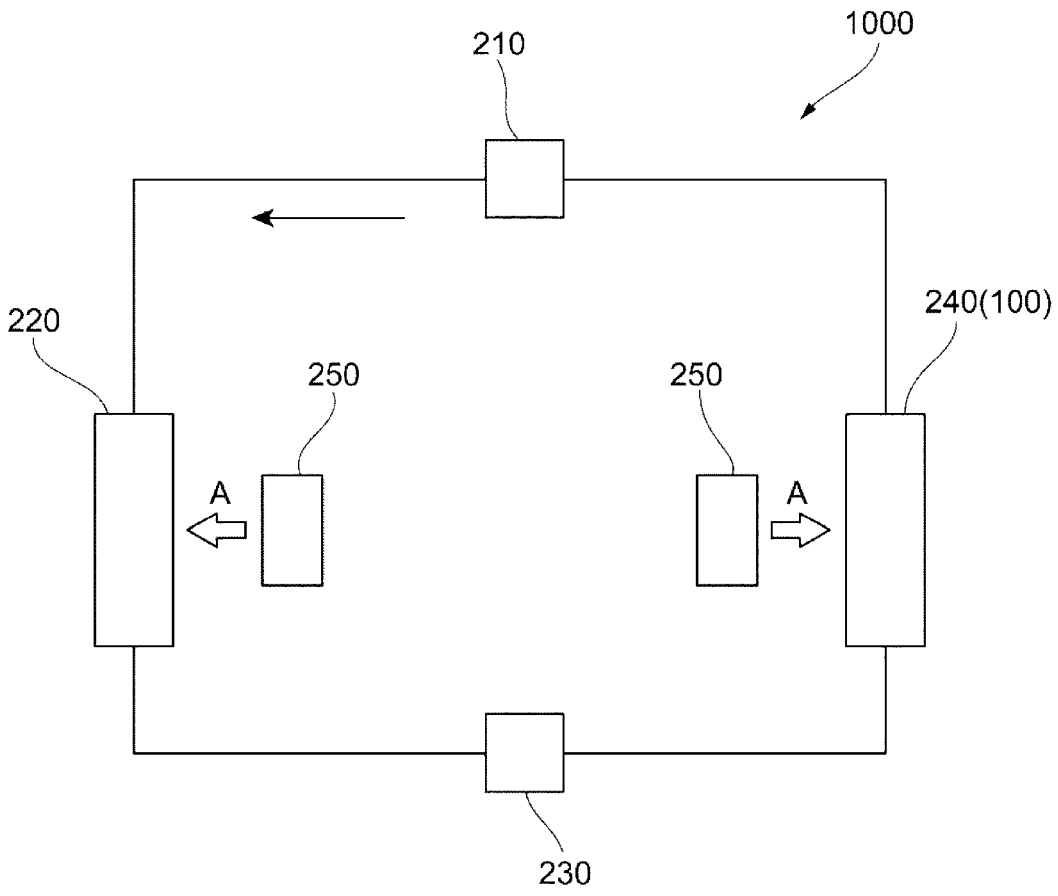
FIG. 9 is a view for describing an air conditioner according to an embodiment of the present disclosure.

FIG. 9 is a view for describing an air conditioner according to an embodiment of the present disclosure.

As illustrated in FIG. 9, the air conditioner 1000 includes a compressor 210, a condensing heat exchanger 220, an expansion device 230, an evaporating heat exchanger 240, and the air blower 250. The air blower 250 is an example of an air blowing means.

The heat exchange 100 according to the present embodiment is applied to the evaporating heat exchanger 240 of the air conditioner 1000 but may also be applied to the condensing heat exchanger 220.

A refrigerant in a high-temperature, high-pressure state is discharged from the compressor 210, is condensed in the condensing heat exchanger 220 such that heat is dissipated therefrom, is expanded in the expansion device 230 and reaches a low-pressure state, is evaporated in the evaporating heat exchanger 240 such that heat is absorbed therefrom, and is absorbed into the compressor 210.

Specific embodiments illustrated in the drawings have been described above. However, the present disclosure is not limited to the embodiments described above, and those of ordinary skill in the art to which the disclosure pertains should be able to modify and embody the present disclosure in various other ways without departing from the gist of the technical idea of the disclosure that is defined in the claims below.

The invention claimed is:

1. An air conditioner including a compressor configured to compress refrigerant and a heat exchanger provided for heat exchange between refrigerant and air, the heat exchanger comprising:

a plurality of refrigerant tubes that are disposed with a clearance (C) therebetween in a first direction (A), in which the air moves, and are disposed to be spaced apart in a second direction (B) crossing the first direction (A); and a plurality of heat exchange fins that are disposed between the plurality of refrigerant tubes disposed to be spaced apart in the second direction (B), wherein each of the plurality of heat exchange fins includes a first portion disposed at an upstream side in the first direction (A), a second portion disposed at a downstream side in the first direction (A), and a valley portion disposed between the first portion and the second portion in the first direction (A) so as to correspond to the clearance (C), each of the first portion and the second portion including a first inclined portion inclined upward toward the downstream side in the first direction (A) and a second inclined portion inclined downward toward the downstream side in the first direction (A), and wherein each of the plurality of heat exchange fins further includes a peak portion disposed to be higher than the valley portion and provided in the first portion and the second portion so as to form a boundary between the first inclined portion and the second inclined portion.

2. The air conditioner of claim 1, wherein the first portion and the second portion are provided so that the first inclined portion of the first portion and the second inclined portion of the second portion face each other while the valley portion is disposed therebetween or the second inclined portion of the first portion and the first inclined portion of the second portion face each other while the valley portion is disposed therebetween.

3. The air conditioner of claim 1, wherein the plurality of refrigerant tubes include a first refrigerant tube disposed to correspond to the first portion of each of the plurality of heat exchange fins in the first direction (A) and a second refrigerant tube disposed to correspond to the second portion of each of the plurality of heat exchange fins in the first direction (A), and wherein each of the plurality of heat exchange fins further includes an upstream side end portion, which extends toward the upstream side in the first direction (A) from the first portion thereof so as to be disposed at an upstream side that is higher than the first refrigerant tube in the first direction (A), and a downstream side end portion, which extends toward the downstream side in the first direction (A) from the second portion thereof so as to be disposed at a downstream side that is lower than the second refrigerant tube in the first direction (A).

4. The air conditioner of claim 3, wherein a length of the upstream side end portion of each of the plurality of heat exchange fins that extends in the first direction (A) is longer than a length of the downstream side end portion of each of the plurality of heat exchange fins that extends in the first direction (A).

5. The air conditioner of claim 1, wherein each of the plurality of heat exchange fins further includes a plurality of slits formed in the first portion and the second portion so as to be disposed side by side in the first direction (A).

6. The air conditioner of claim 5, wherein the plurality of slits include first slits formed in the first inclined portion of the first portion and the first inclined portion of the second portion and second slits formed in the second inclined portion of the first portion and the second inclined portion of the second portion, and wherein a number of first slits is less than the number of second slits.

7. The air conditioner of claim 1, wherein a length of the first inclined portion of the first portion extending in the first direction (A) is shorter than a length of the second inclined portion of the first portion extending in the first direction (A), and wherein a length of the first inclined portion of the second portion extending in the first direction (A) is shorter than a length of the second inclined portion of the second portion extending in the first direction (A).

8. The air conditioner of claim 1, wherein each of the plurality of heat exchange fins further includes standing fins formed in at least one of the first portion and the second portion so as to protrude upward or downward therefrom.

9. The air conditioner of claim 8, wherein the standing fins include a first standing fin that faces any one of the plurality of refrigerant tubes disposed to be spaced apart in the second direction (B) and a second standing fin that faces another one of the plurality of refrigerant tubes disposed to be spaced apart in the second direction (B) and is disposed to be spaced apart from the first standing fin.

10. The air conditioner of claim 9, wherein the first standing fin includes a first end portion that faces any one of the plurality of refrigerant tubes disposed to be spaced apart in the second direction (B) and a second end portion that is provided at the opposite side of the first end portion so as to face an inner side of the plurality of heat exchange fins and is disposed to be higher than the first end portion, and wherein the second standing fin includes a first end portion that faces the other one of the plurality of refrigerant tubes disposed to be spaced apart in the second direction (B) and a second end portion that is provided at the opposite side of the first end portion so as to face the inner side of the plurality of heat exchange fins and is disposed to be higher than the first end portion.

11. The air conditioner of claim 9, wherein the first standing fin and the second standing fin that are adjacent to each other in the second direction (B) protrude in the same direction, which is either upward or downward from the plurality of heat exchange fins.

12. The air conditioner of claim 8, wherein a portion of each of the plurality of heat exchange fins is cut and bent upward or downward from each of the plurality of heat exchange fins so as to form the standing fins.

13. The air conditioner of claim 1, wherein the plurality of heat exchange fins are stacked apart by gaps (FP) in a third direction (F) crossing the first direction (A) and the second direction (B), and wherein a gap (G) between the valley portion and the peak portion in the third direction (F) corresponds to 0.3 to 1.0 times the gap (FP) between the plurality of heat exchange fins.

14. The air conditioner of claim 1, wherein the plurality of heat exchange fins include a first group provided to be inclined toward any one of the plurality of refrigerant tubes disposed to be spaced apart in the second direction (B) and a second group provided to be inclined toward another one of the plurality of refrigerant tubes disposed to be spaced apart in the second direction (B).

15. A heat exchanger provided for heat exchange between refrigerant and air, wherein:

the heat exchanger includes a plurality of refrigerant tubes that are disposed with a clearance (G) therebetween in a first direction (A), in which the air moves, and are disposed to be spaced apart in a second direction (B) crossing the first direction (A) and a plurality of heat exchange fins that are disposed between the plurality of refrigerant tubes disposed to be spaced apart in the second direction (B); and each of the plurality of heat exchange fins includes a first inclined portion inclined upward toward a downstream side in the first direction (A) and a second inclined portion inclined downward toward the downstream side in the first direction (A), wherein each of the plurality of heat exchange fins further includes a peak portion disposed to be higher than a valley portion and provided in the first inclined portion and the second inclined portion so as to form a boundary between the first inclined portion and the second inclined portion.

16. The heat exchanger of claim 15, wherein each of the plurality of heat exchange fins further includes a plurality of slits formed in the first inclined portion and the second inclined portion so as to be disposed side by side in the first direction (A).

17. The heat exchanger of claim 16, wherein the plurality of slits include first slits formed in the first inclined portion and second slits formed in the second inclined portion, and wherein the number of the first slits is different from the number of second slits.

18. The heat exchanger of claim 15, wherein a length of the first inclined portion extending in the first direction (A) is different from a length of the second inclined portion extending in the first direction (A).

19. The heat exchanger of claim 15, wherein each of the plurality of heat exchange fins further includes a valley portion disposed between the first inclined portion and the second inclined portion and disposed to be lower than the first inclined portion and the second inclined portion.

20. The heat exchanger of claim 19, wherein the valley portion is disposed between the first inclined portion and the second inclined portion in the first direction (A) so as to correspond to the clearance (G).

* * * * *